US009332847B2

(12) United States Patent
McLellen

(10) Patent No.: US 9,332,847 B2
(45) Date of Patent: May 10, 2016

(54) POWERED ROCKER SYSTEM ASSEMBLE

(71) Applicant: Arthur Oscar McLellen, Woodstock, GA (US)

(72) Inventor: Arthur Oscar McLellen, Woodstock, GA (US)

( * ) Notice: Subject to any disclaimer, the term of this patent is extended or adjusted under 35 U.S.C. 154(b) by 237 days.

(21) Appl. No.: 13/738,520

(22) Filed: Jan. 10, 2013

(65) Prior Publication Data

US 2014/0191548 A1 Jul. 10, 2014

(51) Int. Cl.
*A47C 3/02* (2006.01)

(52) U.S. Cl.
CPC ..... *A47C 3/02* (2013.01)

(58) Field of Classification Search
CPC ..... A47D 13/10; A47D 9/02
USPC ..... 297/60.2, 260.2; 5/109
See application file for complete search history.

(56) References Cited

U.S. PATENT DOCUMENTS

| | | | | |
|---|---|---|---|---|
| 1,984,397 | A | 12/1934 | Dalyze | |
| 3,019,052 | A | 1/1962 | Zawadzki et al. | |
| 3,758,156 | A | 9/1973 | Zawadzki et al. | |
| 3,818,517 | A | 6/1974 | Casella | |
| 4,211,401 | A * | 7/1980 | Cunard | 472/119 |
| 4,775,184 | A | 10/1988 | Larkin | |
| 4,911,499 | A | 3/1990 | Meeker | |
| 5,368,361 | A | 11/1994 | Wen-Ming | |
| 5,860,698 | A | 1/1999 | Asenstorfer et al. | |
| 6,152,529 | A | 11/2000 | Beason | |
| 6,318,803 | B1 | 11/2001 | Garland | |
| 6,412,867 | B2 | 7/2002 | Robinson | |
| 7,537,285 | B2 | 5/2009 | Stewart | |
| 2003/0047973 | A1 * | 3/2003 | Pellerin | 297/260.2 |
| 2007/0007804 | A1 * | 1/2007 | Pemberton et al. | 297/260.2 |
| 2007/0063558 | A1 * | 3/2007 | Stewart | 297/260.2 |
| 2011/0248535 | A1 * | 10/2011 | LaPointe | 297/260.2 |
| 2012/0022412 | A1 | 1/2012 | Bryant | |
| 2012/0212022 | A1 * | 8/2012 | Godbout et al. | 297/260.2 |
| 2013/0214575 | A1 * | 8/2013 | Harding et al. | 297/260.2 |

* cited by examiner

*Primary Examiner* — David E Allred
*Assistant Examiner* — Alexander Harrison
(74) *Attorney, Agent, or Firm* — Bradley D. Crose; Crose Law LLC

(57) ABSTRACT

A powered rocker system assemble is disclosed that includes a motorized rocking mechanism with a rotational motor drive and to an automatic transmission assemble configured to automatically force the balance the rotational motion cycle with the newly balanced position of the occupied chair before switching from manual to powered rocking and a device referred to as a powered pawl controller which is configured to allow the rocking chair to rock while in the recline position with the leg rest extended.

13 Claims, 7 Drawing Sheets

POWERED ROCKER SYSTEM ASSEMBLE

CROSS-REFERENCE TO RELATED APPLICATION(S)

The present non-provisional patent application claims the benefit of priority of U.S. Provisional Patent Application No. 61/586,199, which is entitled "Powered Rocker System Assembly", which was filed on Jan. 13, 2012, and which is incorporated in full by reference herein.

FIELD OF THE INVENTION

The technology described herein relates generally to an apparatus, system, and associated methods for creating a powered rocking motion for a recliner rocker, glider rocker, rocker crib, or the like. More specifically, this technology relates to an apparatus adapted to attach to a rocking chair that automatically adjusts to the balance of the chair, before transferring the operations from manual to powered rocking and controls the pawl to rock a recliner rocking chair with the leg rest extended.

BACKGROUND OF INVENTION

This section provides background information related to present disclosure and may not necessarily be in present art.

People enjoy relaxing in the comfort of a chair that rocks or glides in a reciprocatory motion. The motion may have a soothing effect and lend to put the occupant of the chair to sleep. However, the chair needs propelling in some manner. The propulsion is usually accomplished by the occupant of the chair pushing on the floor with his or her legs and feet, while sitting thereon. After a period of time, the occupant of the chair usually stops pushing due to exhaustion or falling asleep. To continue the reciprocatory motion, the occupant of the chair may have to resume with their feet, which prevents the occupant of the chair from sleeping in the chair, or make other arrangements.

There has been a long recognized need to allow an individual to rock in a reclined position with their legs and feet elevated on the leg rest or ottoman. This position also allows the occupant of the chair to sleep more comfortably in the chair. This popular position, being the more comfortable, will not allow the feet of the occupant of the chair to come in contact with the floor surface for propulsion.

Additionally, the present art of a reclining rocking chairs with a leg rest has two frames. One is the frames is the base of the chair with feet and the other is the frame of the seat of the chair that rocks on top of the frame of the base of the chair. This present art has a pawl and ratchet latching mechanism that latches when the leg rest is extended to hold the position of the frame of the seat of the chair to the frame of the base of the chair to prevent the chair from tilting too far forward, while over balanced. This latching also prevents the chair from any rocking motion and restricts the occupant of the chair from manually or powered rocking the chair.

Heretofore, such present art has suffered from several deficiencies. Specifically, present art does not address the problem of balancing the rocking chair when the occupant sits on it before the motor drive engages to create the rocking motion. Also the motion cycle should be balanced with the balance of the chair to equal a balanced system. When using a powered rocker system with a rotary or linear motion drive, the chair should be balance in the middle of the motion cycle before beginning the rocking motion. The middle of the motion cycle is the middle between the maximum and minimum length of the stroke for linear motion and the middle of the maximum and minimum height of the motor arm of the rotary cycle. The engaging position for the motor drive will vary depending on the weight of the occupant of the chair and how far backward or forward the occupant of the chair leans when sitting.

Some present art have a locking system for the motor drive linkage that use a solenoid, which uses continual electrical powered to keep the motor drive locked while the motorized rocking mechanism is in use. This continual electrical powered use may cause a heat build up and some safety problems. Some of these mechanisms of the present art having a locking system in the motor drive linkage using a solenoid, which uses continual electrical powered to keep the rotational motor drive locked while the motorized rocking mechanism is in use have been provided, as disclosed in US Patent No. 2011/0248535 A1.

Another deficiency is a rocking mechanisms having a locking motor drive that restricts the rocking distance of the chair while in manual rocking, due to the crank and drive shaft interference in the mechanism. This said mechanism may need to be disconnected from the frame of the chair while rocking manually. Some of these rocking mechanisms of the present art having a locking motor drive that restricts the rocking distance of the chair, while in manual rocking, due to the crank and drive shaft interference in the mechanism have been provided, as disclosed in U.S. Pat. No. 3,019,052.

Some present art uses a rotation motion cycle to power a linear motion cycle for the motor drive movement to create the rocking motion of the chair. One of the most comforting motions for the occupant of the chair is a constant, uninterrupted and smooth rocking and reciprocatory motion which this linear motion will not produce. The linear movement travels to and from a single start point on the motion cycle in a straight line. The motion has two start and stop points in the cycle, with an abrupt transition in change of direction. This causes a jerking and interruptive movement in the motion cycle as the means to rock the chair. Some of these chairs use springs to attempt to absorb or eliminate the shock in the sudden start and stop of the linear motion. But the springs actually create the same jerking and interruptive motion problem they are attempting to resolve, by compressing and expanding in the motion cycle. Some of these mechanisms of the present art having the springs and linear motion have been provided, as disclosed in US Patent No. 2011/0248535 and U.S. Pat. No. 6,152,529.

Some present art uses a striking and release contact method of rocking, which strikes a fixed object and then releases to let gravity finish the motion cycle. This also has an interruptive motion and causes jerking in the motion cycle. Some of these mechanisms of the present art having a striking contact and release method have been provided, as disclosed in U.S. Pat. No. 7,537,285 B2, U.S. Pat. No. 3,886,608 and U.S. Pat. No. 4,775,184. All of these methods have a jerking and interrupting motion for the rocking cycle, which is uncomfortable to the occupant of the chair.

The glider rocker may use a gliding ottoman to rest the legs and feet of the occupant of the chair and also does not allow the feet of the occupant of the chair to come in contact with the floor surface for propulsion. The occupant of the chair can not manually rock the chair in this relaxed position.

A rocking crib is designed to rock when someone is manually pushing it with their hands or such. This manual rocking is very tiring for the operator. A person might like to rock the baby in the crib and also relax or perform other tasks at the same time.

Another deficiency of the present art is a motorized rocking mechanism restricts the movement of the manual rocking of the rocking chair. The mechanism can not revert from powered rocking back to manual rocking without disconnecting the driving mechanism from the frame of the chair or not allowing the chair to rock manually. The changing from manual to powered rocking is not automatic and becomes very inconvenient for the occupant of the chair.

The inventive art attempts to resolve the outlined deficiencies in the present art. Other objects, features, advantages and benefits of the present invention will become apparent upon reading the following specification, when taken in conjunction with the accompanying drawings.

SUMMARY OF THE INVENTIVE ART

The inventive art takes a fresh and different approach to solve the deficiencies in the present art. The inventive art consists of a motorized rocking mechanism disposed within the powered rocker system assemble using a rotational motor drive with an automatic transmission assemble and a powered pawl controller.

The inventive art provides an improved motor for the motorized rocking mechanism by providing a method to stop the motor in the same position in the rotational cycle. This allows the motorized rocking mechanism to start at the same position every time to keep a balance rotational motion cycle.

The inventive art provides an improved motorized rocking mechanism with the use of a rotational motor drive that uses two elongated sliding components. One is located inside the other with ball bearings between the two for the purpose of unrestricted sliding. Each component is attached at opposite ends, one to the motor arm of the motorized rocking mechanism and the other to the frame of the seat of the chair. When the rocking chair rocks backward the two components of the rotational motor drive slide together becoming shorter and when the rocking chair rocks forward the two components of the rotational motor drive slide apart becoming longer. This rotational motor drive allows the chair to manually rock without restrictions from the motorized rocking mechanism and to balances the chair when to chair is occupied.

The inventive art provides another improvement in the motorized rocking mechanism by eliminating the jerking motion created in present art. A rotational motor drive with a continual rotational motion from the motor arm is used to create a smooth, reciprocatory movement to the frame of the seat of the chair. The rotational motion is smoother that a linear motion, which has two start and stop points in the motion cycle. The motor arm provides a constant rotational movement for the rotational motor drive to circularly pull and push the frame of the seat of the chair without start and stop points in the motion cycle. The rotational motion eliminated the need for a spring shock absorber that attempts to eliminate the shock in the motion of present art.

The inventive art also provides an improved motorized rocking mechanism with a device referred to as an automatic transmission assemble, which is attached to the rotational motor drive and provides a method to automatically adjust the rotational motor drive to a newly balanced position of the chair before switching from manual to powered rocking, thereby keeping the rocking chair balanced and a method to switch the rotational motor drive to powered rocking, which locks the two sliding components of the rotational motor drive together and makes a rigid link between the motor and the frame of the seat of the rocking chair to create the rocking and reciprocatory motion provided by the motor and rotational motor drive. The automatic transmission assemble also provides a method to unlock the two sliding components of the rotational motor drive to allow the components to independently slide within each other, for manual rocking without detaching the motorized rocking mechanism from the frame of the seat of the chair, for the convenience of the occupant of the chair. The automatic transmission assemble works in unison and turns on and off simultaneously with the motor of the motorized rocking mechanism.

The inventive art provides a powered pawl controller, which is a device for controlling the pawl and ratchet latching mechanism of a chair which has such a mechanism. The powered pawl controller, being new to a powered rocker system, may not be found in present art. The pawl and ratchet latching mechanism latches the position of the chair when the leg rest is extended, to prevent the unbalanced chair from moving. The powered pawl controller will latch and unlatch the pawl of the chair at the discretion of the operator and works in unison with the motor and automatic transmission assemble of the motorized rocking mechanism to allow the chair to rock in a recline position with the leg rest extended.

The advantage of the technology described herein is to provide a powered rocker system assemble which is readily attachable to the frame of the rocking chair with a method of switching back and forth from manual to power rocking and operates both without disconnecting the motorized rocking mechanism from the frame of the chair, a method to automatically adjust to a newly balanced position of the frame of the seat of the chair before switching from manual to powered rocking, a method to power rock the chair in a smooth, reciprocatory motion, a method to power rock a reclining rocking chair containing the pawl and ratchet latching mechanism in a recline position with the leg rest extended, for the comfort of the occupant of the chair.

DESCRIPTION OF THE DRAWINGS

The drawings described herein are for illustrative purposes only of selective embodiments and not all possible implementations, and are not intended to limit the scope of the present disclosure.

DETAILED DESCRIPTION OF THE INVENTION

Figure 1:
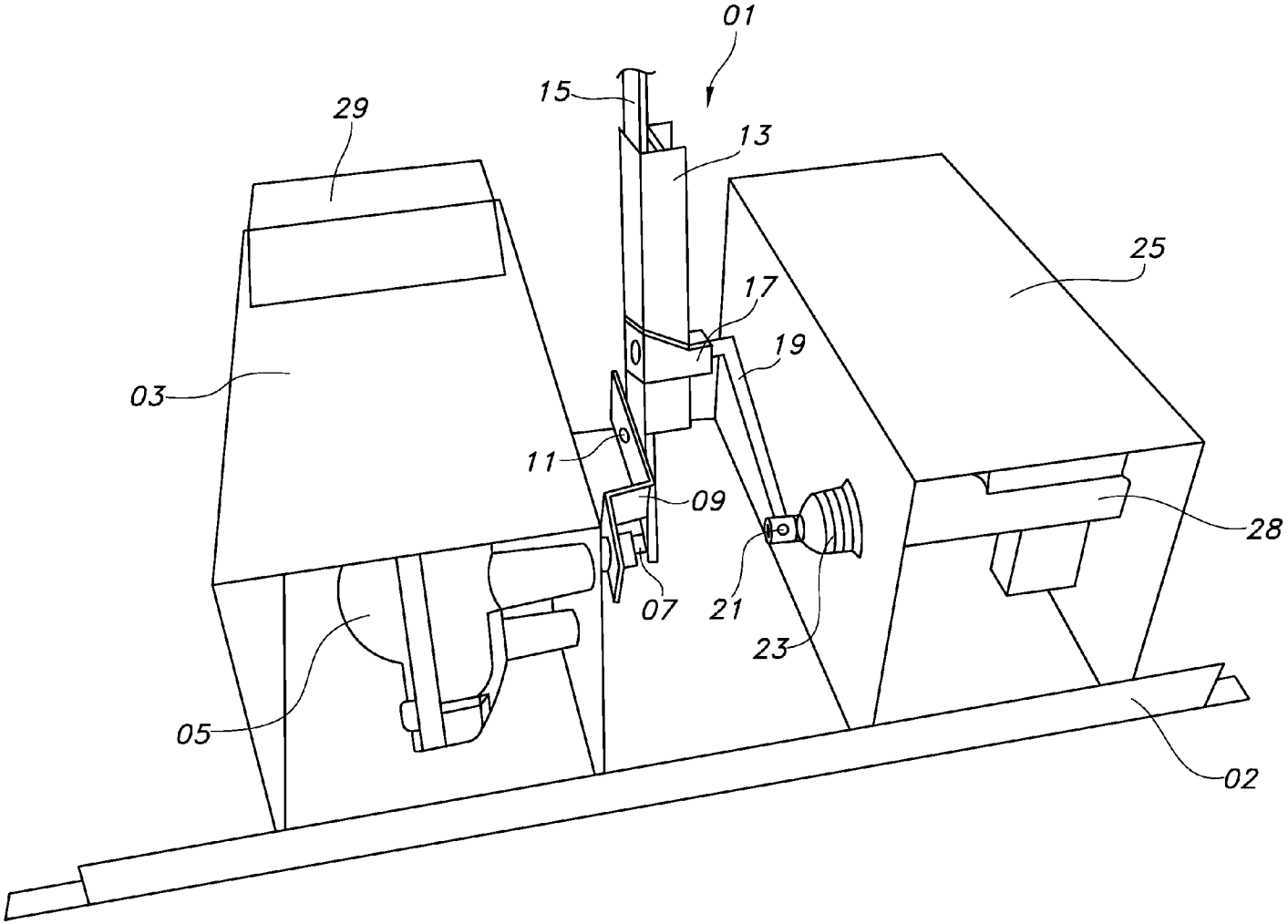
FIG. 1 is the front top perspective view of the powered rocker system assemble illustrated with a motor housing on the left, an automatic transmission assemble on the right and the rotational motor drive in the middle.

Before describing the disclosed embodiments of this technology in detail, it is to be understood that the technology is not limited in its application to the details of the particular arrangement shown here, since the technology described is capable of other embodiments. Also the terminology used herein is for the purpose of description and not of limitation.

In various exemplary embodiments, the technology described herein provides a device, system, and associated methods to provide a smooth, reciprocatory movement to a rocking recliner chair, rocking glider chair, rocking crib and other objects for the comfort of the occupant of the chair. The device comprises a self-contained unit which is attached to the frame of the seat of the rocking recliner chair using several different mounting configurations and mounting on other objects may have a different mounting configuration.

Referring now to Figures, a powered rocker system assemble 01 is disclosed. The powered rocker system assemble 01 includes a motorized rocking mechanism which includes a motor 05, a rotational motor drive with an automatic transmission assemble 20 attached, a powered pawl controller 31 and a circuit board controller with power source 29. The powered rocker system assemble 01 is configured to be releasable secured to the frame of the chair. The rocking chair has a frame of the seat of the chair 22 which rocks on top of the frame of the base of the chair 54. The frame of the base of the chair 54 has the chair feet attached and sits on the floor. The powered rocker system assemble 01 is positioned on the floor at the back of the chair, with reference to the frame, and is securely connected to the chair with the chair connector pin 16 attached to the frame of the seat of the chair 22 and the feet of the rocking chair sitting on top of the frame angle rod 02. The weight of the chair secures the powered rocker system assemble 01 to the floor and the frame of the base of the chair 54.

Figure 3:
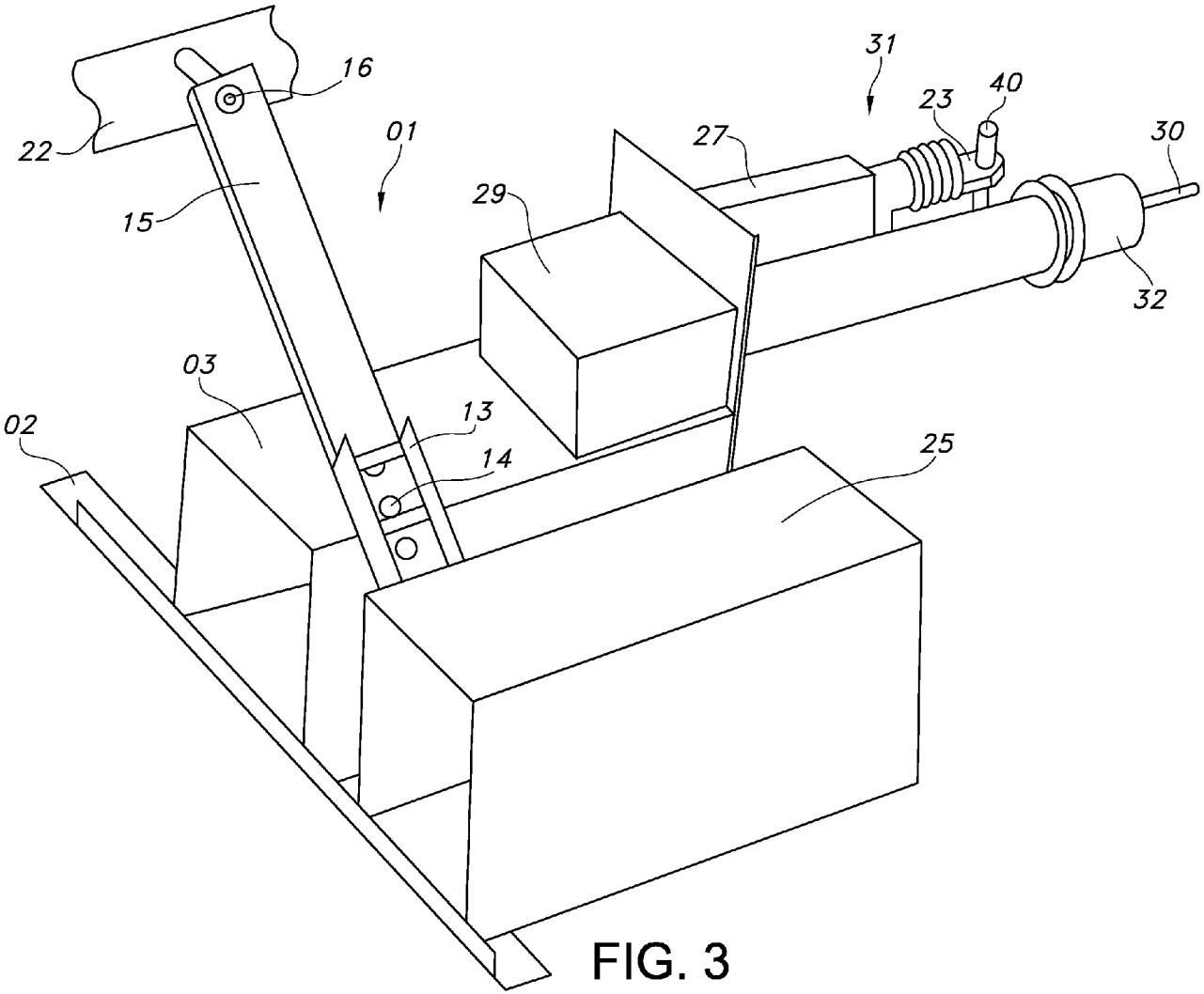
FIG. 3 is the front right side top perspective view of FIG. 1.

Referring to FIGS. 1 and 3, the motorized rocking mechanism further includes the motor 05 disposed inside the motor housing 03 and is configured to power the rocking motion provided to the frame of the seat 22 of the chair. The motor 05 and automatic transmission assemble 20 work in unison and turn on and off simultaneously. The motor 05 is attached to the circuit board controller with a power source 29 which provides the electrical power and controls the functions of the motor 05. The motor 05 is attached to an internal geared motor shaft 07. The motor 05 is configured to stop the internal geared motor shaft 07 at the same predetermined rotational position each time the motor 05 is deactivated. The geared motor shaft 07 is attached to the rotational motor drive at the motor arm 09 using fastener hardware.

Figure 4:
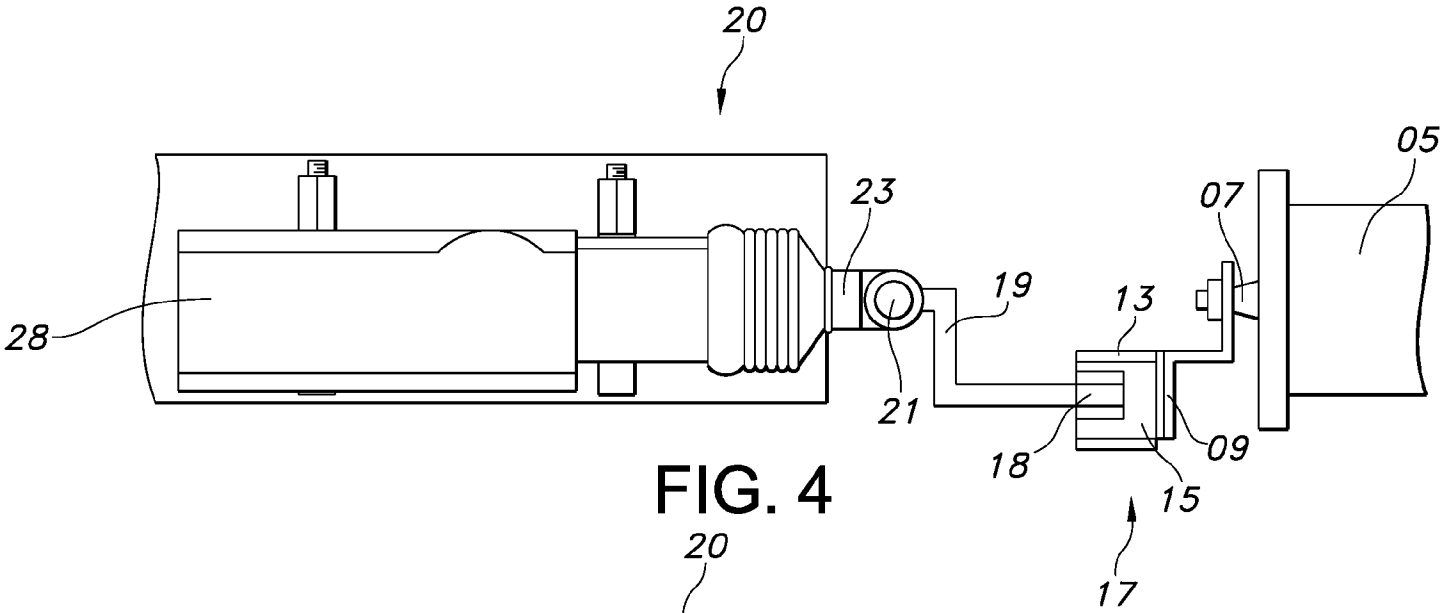
FIG. 4 is the top side cross section view illustrating the section of the unlocked automatic transmission in the automatic transmission assemble.

Referring to FIGS. 1 and 4, the motorized rocking mechanism further includes a rotational motor drive which comprises the motor arm 09 attached to the motor connector 13 using rotational hardware. The continual stopping position of the motor arm 09 is at ninety degrees off of top center of the rotational cycle and is at the middle of the maximum and minimum height of the motion cycle, with reference to the motor arm 09, to provide a rocking motion with a balanced rotational motion cycle. The motor connector 13 encompasses the chair connection slide 15 that has multiple slider holes 14 located along the length and the chair connector pin 16 located at the end. The connector pin 16 is attached to the frame of the seat of the chair 22. The motor connector 13 and with the chair connection slide 15 are separated with ball bearings (not shown) to allow the chair connection slide 15 to freely slide up and down, with respect to the frame, inside the motor connector 13 for manual rocking without restriction from the motorized rocking mechanism and to balance the rocking chair when occupied without disconnecting the powered rocker system assemble 01 from the frame of the seat of the chair 22. These components of the rotational motor drive are located between the motor 05 and the frame of the seat of the chair 22 and are configured to provide a rigid connection from the motor 05 to the frame of the seat of the chair 22 when the automatic transmission assemble is activated.

Figure 5:
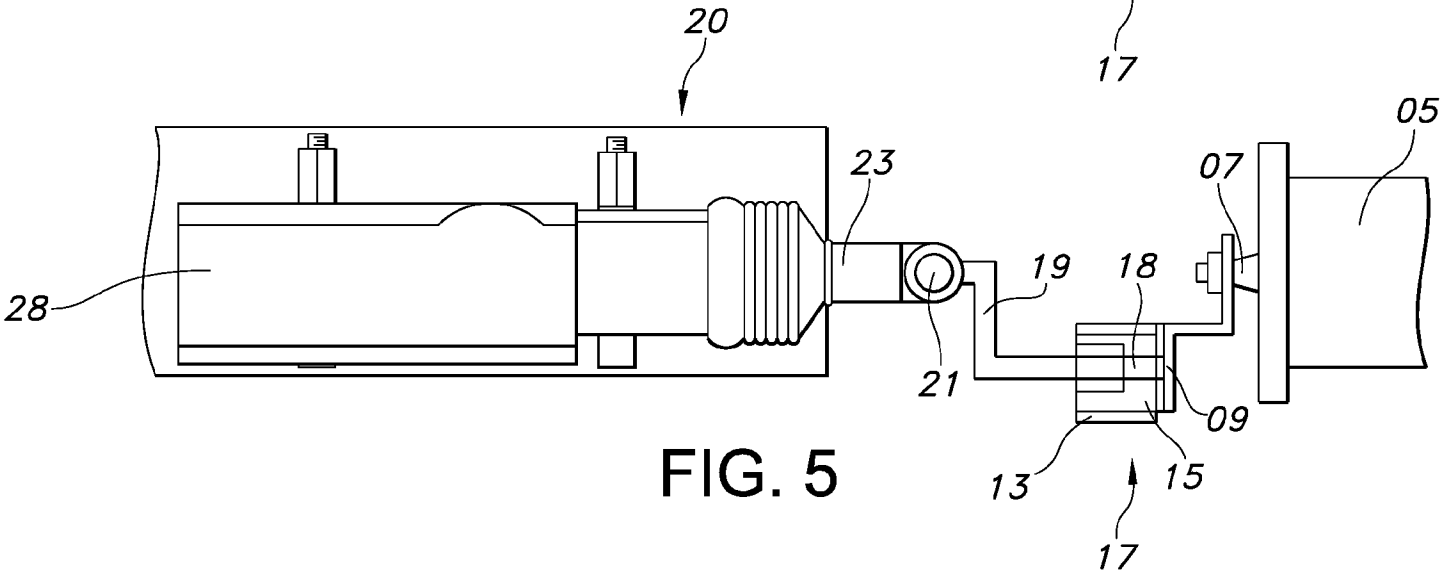
FIG. 5 is the same view as depicted in FIG. 4 illustrating the locked automatic transmission in the automatic transmission assemble.

Referring to FIGS. 1, 4, and 5, the rotational motor drive of the motorized rocking mechanism further includes an automatic transmission assemble 20. The automatic transmission assemble 20 includes the actuator housing 25, actuator 28, actuator drive rod 23, rotational fastener 21, transmission drive rod 19, spring loaded pin 18, and the automatic transmission 17. The automatic transmission assemble 20 is configured to automatically lock and unlock the components of the rotational motor drive to make a rigid link between the motor 05 and the frame of the seat of the chair 22, to switch from powered to manual rocking without disconnecting the powered rocker system assemble 01 from the frame of the chair, and to automatically adjust to a newly balanced position of the chair before locking the rotational motor drive to create powered rocking, The automatic transmission assemble 20 is attached in the powered rocker system assemble 01 with the actuator housing 25 attached to the frame angle rod 02 and the automatic transmission 17 is attached to the rotational motor drive at the motor connector 13 using fastener hardware. The actuator 28 is attached inside the actuator housing 25 and provide the power for the functions of the automatic transmission assemble 20. The actuator drive rod 23 is internally attached in the actuator 28 to extend and retract when activated. The actuator drive rod 23 has an exposed end with a rotational fastener 21. The rotational fastener 21 is attached to the transmission drive rod 19. The other end of the transmission drive rod 19 is attached to the spring loaded pin 18 which is located inside the automatic transmission 17 and is free to move in and out of the chair connection slide 15 with multiple slider holes 14. When the powered rocker system assemble 01 is activated, the motor 05 and automatic transmission assemble 20 are activated simultaneously. The actuator 28 pushes the spring loaded pin 18 into the slider hole 14 to lock the rotational motor drive components and the motor 05 turns the motor arm 09 to provide movement to the rotational motor drive for the rocking motion. The actuator 28 is deactivated after the short period of time, and the automatic transmission 17 remains locked. This deactivation of the actuator 28 eliminates the continual electrical power use and prevents any over heating, while the motorized rocking mechanism is operating.

The spring loaded pin 18 further includes a compression spring inside the housing of the spring loaded pin 18 (not shown). If the automatic transmission assemble 20 is activated and the spring loaded pin 18 and the slider hole 14 are not aligned for locking, the spring loaded pin 18 will compress against the side of the chair connection slide 15 and remain compressed until the motor arm 09 rotates the motor connector 13 to make the alignment. The motor arm 09 rotates the motor connector 13 with an opposite force against the chair connection slide 15 and the chair connection slide 15 will slide up or down, with respect to the frame, inside the motor connector 13 until the spring loaded pin 18 and the slider hole 14 align, which will be at the balance point of the frame of the seat of the chair 22 on the frame of the base 54, FIG. 10. Once aligned, the force of the compressed spring inside the frame of the spring loaded pin 18 will insert the spring loaded pin 18 into a slider hole 14 and lock. The chair is now balanced and the automatic transmission 17 is locked, the motor 05 is running with the motor arm 09 rotating the rotational motor drive and creating the rocking and reciprocatory motion.

Referring to FIGS. 1, and 4, the automatic transmission assemble 20 further includes a method to unlock the motor drive. When the motor 05 is deactivated, the circuit board controller with a power source 29 will unlocking of the automatic transmission 17 by activating the actuator 28 in the reverse direction for a short period of time to pull the spring loaded pin 18 out of the chair connection slide 15 with slider hole 14. This allows the chair connection slide 15 to freely slide inside the motor connector 13 and allow manual rocking without any restriction from the motorized rocking mechanism and without disconnecting the powered rocker system assemble 01 from the frame of the seat of the chair 22. After the spring loaded pin 18 has been removed out of the chair connection slide 15 with slider hole 14, the actuator is deactivated by the circuit board controller with a power source 29 to eliminate continual electrical power use and prevents any over heating. Simultaneously, the motor 05 will rotates the motor arm 09 back to the original stop position, controlled by the circuit board controller with power source 29, before stopping.

Referring to FIGS. 1 and 3, the rotational motor drive further includes the balancing of the reclining rocking chair. The reclining rocking chair is balanced when unoccupied. The frame of the seat of the chair 22 is balanced on the frame of the base 54 and feet of the chair, FIG. 10. When a weight is placed on the seat of the chair, the frame of the seat of the chair 22 may move and reposition from the original balanced position to a newly balanced position. When the powered rocker system assemble 01 is attached to the frame of the seat of the chair 22, this repositioning could move the frame of the seat of the chair 22 either forward or backward, with respect to the frame, and the frame of the seat of the chair 22 moves the connected chair connection slide 15 with multiple slider holes 14 up or down, with respect to the frame, inside the confines of the motor connector 13, to balance the weight. When moving the seat of the chair backward, with reference to the frame, the two rotational motor drive components comprising of the motor connector 13, the chair connection slide 15 with multiple slider holes 14 contracts to shorten the rotational motor drive to a newly balance position, and when moving the seat of the chair forward, with reference to the frame, the two rotational motor drive components comprising of the motor connector 13, the chair connection slide 15 with multiple slider holes 14 expands to lengthen the rotational motor drive to a newly balanced position. The chair connection slide 15 has closely located, multiple slider holes 14. The multiple slider holes 14 will move up and down relative to the balance position of the frame of the seat of the chair 22 and the fixed position of the spring loaded pin 18. The automatic transmission 17 when activated will automatically adjust to any newly balanced position along the length of the chair connection slide 15 of the rotational motor drive before locking the spring loaded pin 18 into the selected slider hole 14. The closeness and positioning of the multiple slider holes 14 minimizes any distance from the balanced position and locking point on the rotational motor drive. The weight is balanced first before the motor 05 and automatic transmission assemble 20 is activated. The selection of slider hole 14 is based on the balanced position of the chair. The balance position of the chair is based on the weight and position of the occupant of the chair on how far forward or backward the occupant of the chair is leaning, before activating the powered motorized rocking mechanism. Once the automatic transmission 17 locks the motor connector 13 together with the chair connection slide 15 using the spring loaded pin 18, the chair is balanced, the rotational motor drive has a rigid link from the motor 05 to the frame of the seat of the chair 22. The chair is then completely balanced when the motor 05 starts the rotational movement from the balance rotational motion cycle position. The motor 05 is now rotating the motor arm 09 to create the smooth, rocking motion. The multiple slider holes 14 eliminate the necessity for spring shock absorbers by making a secure nonslip connection between the two components of the rotational motor drive, for the smooth, reciprocatory movement to the chair. The automatic transmission assemble 20 allows the motorized rocking mechanism to start the motor 05 at a balanced equilibrium position and remove any overweighted strain from the motor 05.

The rocking motion includes the smooth, reciprocatory movement by using a repetitive, rotational cycle motion from the motor 05 to the frame of the seat of the chair 22 through a rigid connection of the rotational motor drive. The rotational cycle motion begins with the frame of the seat of the chair 22 starting at the center of the height of the rotational cycle. The motor arm 09 starting at the ninety degrees off top center and the components of the motor drive locked and using a rotational motion, not a linear motion, pushes the frame of the seat the chair 22 down, in reference to the frame and floor, to a minimum height point or bottom of the rotational cycle. The motor arm 09 continues to pushes the frame of the seat of the chair 22 up, in reference to the frame and floor, past the center point to the maximum height point or top of the rotational cycle and again pushes the frame of the seat the chair 22 down to the center point, completing one cycle. The rotational cycle motion has a normal rocking velocity based on the revolution per minutes of the motor 05. When the motor arm 09 approaching the minimum height point or maximum height point in the rotational cycle, the normal rocking velocity of the chair gradually decreases, due to the circular motion of the motor arm 09 and after passing the minimum height point or maximum height point the rocking velocity gradually increases until reaching the normal rocking velocity, due to the circular motion of the motor arm 09. This action prevents the jerky, abrupt transition in the change of direction in a linear motion cycle. The continual rotational motion is smoother that a linear motion, which has two start and stop points in the linear motion cycle. The rotational motion eliminated the need for the spring shock absorber. The motor connector 13, an automatic transmission 17, and the chair connection slide 15 create the rigid, nonslip connection. Once the automatic transmission 17 locks, there is no interruption in the motion in either direction between the motor connector 13 and the chair connection slide 15 and there is no start and stop in the motion cycle. The motor 05 provides the power, the automatic transmission 17 provides the rigid connection within the rotational motor drive, and the motor arm 09 provides a constance rotational movement to circularly pull and push the frame of the seat of the chair 22.

Referring to FIG. 1, the automatic transmission assemble 20 further comprises the attachment of the transmission drive rod 19. When the actuator and motor 05 are activated and the rotational motor drive including the motor arm 09, the chair connection slide 15, the motor connector 13, and the automatic transmission 17 rotate around the geared motor shaft 07, the transmission drive rod 19 follows along in the rotation.

In another exemplary embodiment, the technology described herein is provided with an automatic transmission assemble 20 including the actuator 28, the transmission drive rod 19 and spring loaded pin 18 is attached to the side of the automatic transmission 17 using fastener hardware. This embodiment allows the automatic transmission assemble 20 to rotation with the rotational motor drive around the geared motor shaft 07 and eliminate the actuator housing 25 and the use of the rotational fastener 21.

Figure 2:
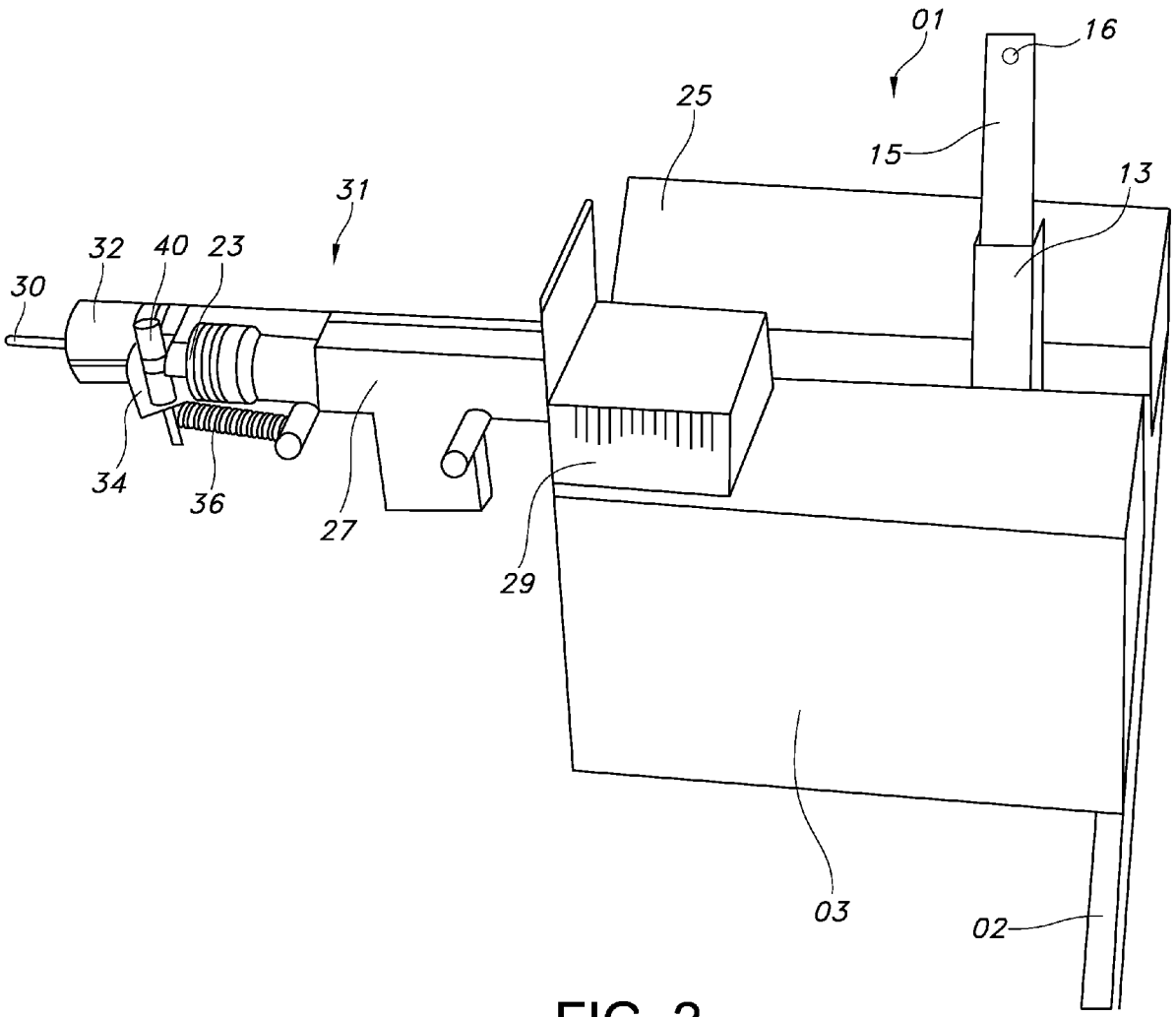
FIG. 2 is the left side top prospective view of FIG. 1 illustrated with the pawl controller attached to the top back side of the motor housing.
Figure 10:
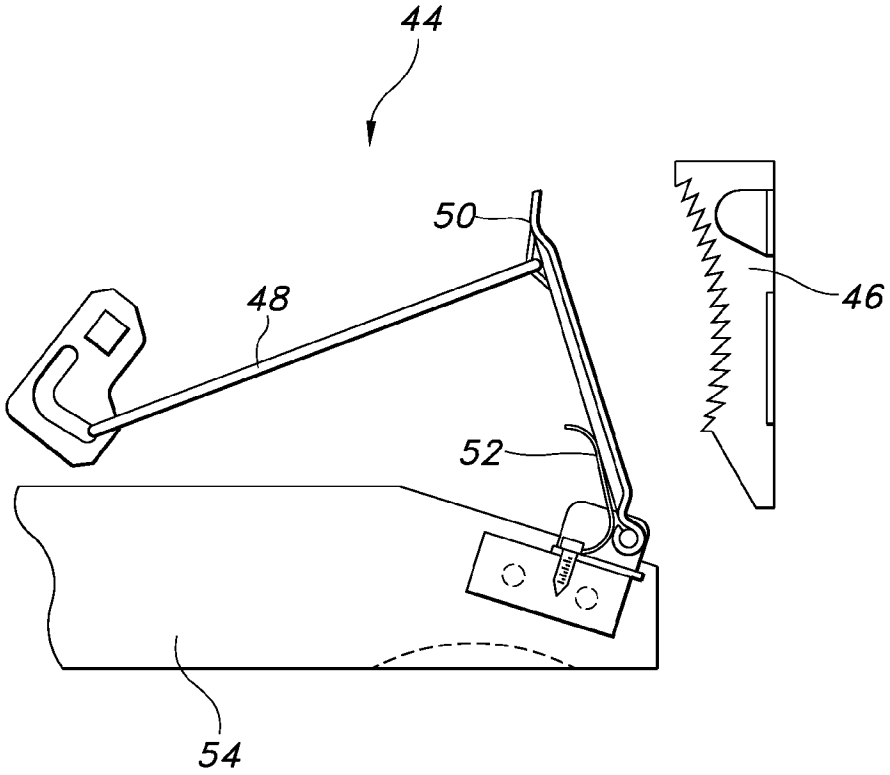
FIG. 10 is the right side view of the pawl and ratchet latching mechanism which is incorporated in the frame of the chair and the property of the manufacturer of the reclining rocking char, illustrating the pawl and ratchet latching mechanism mounted to the frame of the base of the chair and the ratchet hardware mounted to the frame of the seat of the chair. The view shows the ratchet hardware mounted on the frame of the rocking chair closest to the leg rest and the pawl in not latched to the ratchet hardware.

Referring to FIGS. 2, 3 and 10, the powered rocker system assemble 01 further includes a powered pawl controller 31 attached to the motor housing 03 at the rear top side facing the leg rest of the chair using fastener hardware and configured to provide control over the functions of the pawl and ratchet latching mechanism 44 of the manufacturer of the chair by attaching the connector rod 30 of the powered pawl controller 31 to the pawl connector rod 48 of the pawl and ratchet latching mechanism 44 of the chair, shown in FIG. 10 and using the circuit board controller with a power source 29 to control the functions of the pawl actuator 27 to allow rocking, while the leg rest is extended.

Referring to FIG. 10, the pawl and ratchet latching mechanism 44 of the chair provided by the manufacturer includes the pawl connector rod 48 with the pawl 50 attached, the ratchet hardware 46 attached to the frame of the seat of the chair 22 just below the leg rest, and the pawl spring 52 which is attached to the base chair frame 54 and pushes forward against the pawl 50, with reference to the frame. The pawl and ratchet latching mechanism 44 is operable to releasable lock the frame of the seat of the chair 22 in a rearward tilted position upon extension of the leg rest and allow multiple positioning adjusts while permitting unrestricted rocking action when the leg rest is protracted. A rotational spring loaded lever on the side of the chair (not shown) is attached to the pawl connector rod 48 and operates the manual latching of the pawl 50 to the ratchet hardware 46 of the chair. Normally, the chair will not latch until the rotational spring loaded lever is rotated and leg rest is extended.

Figure 6:
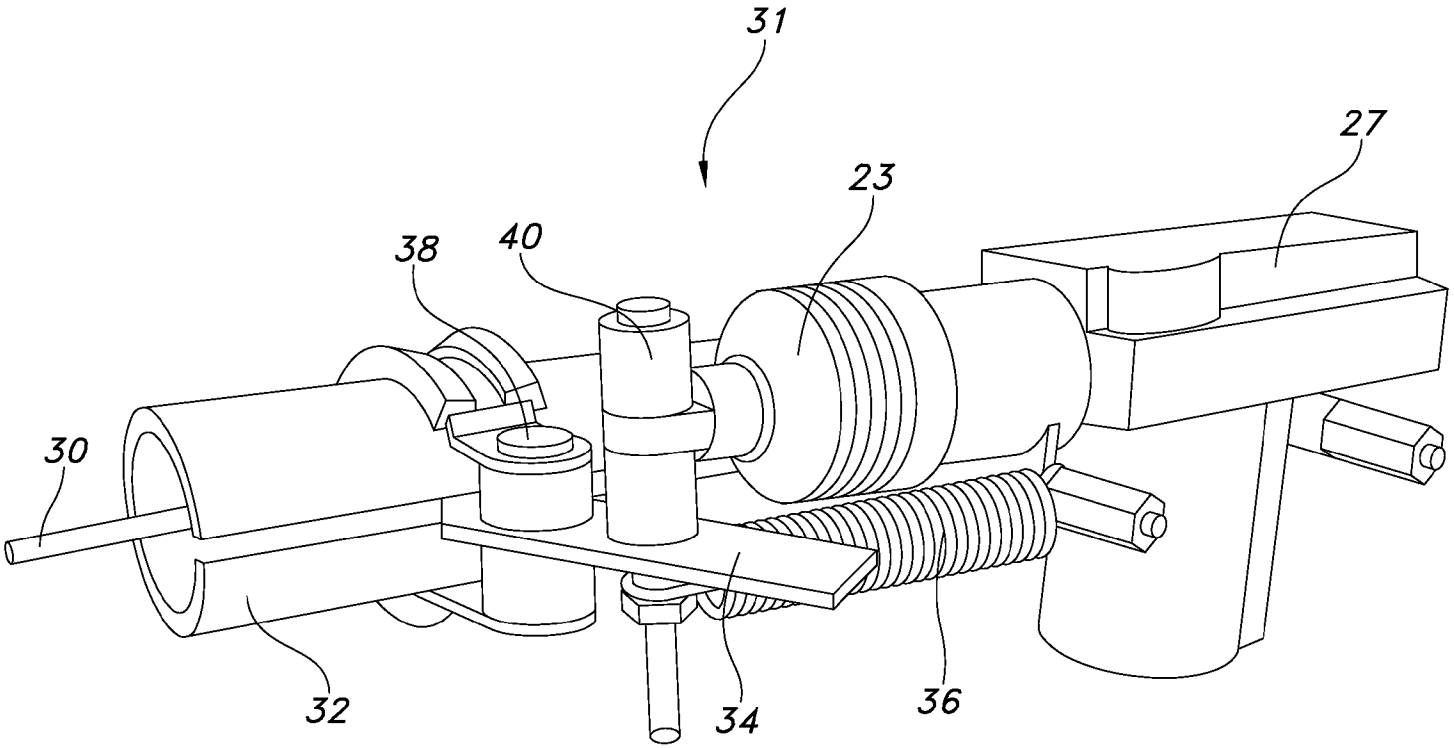
FIG. 6 is the rear left side perspective view illustrating the powered pawl controller.

Referring to FIG. 6, the powered pawl controller 31 further includes a pawl actuator 27, a pawl actuator drive rod 23, a connector rod 30, a driver tube 32, a key 34, a key spring 36, a pivot connector 38, and a pawl rotational fastener 40. The pawl actuator 27 is attached to the left side of the driver tube 32 using fastener hardware. The pawl actuator drive rod 23 is attached to the pawl actuator 27 internally to extend and retract, when activated. The key 34 is attached to the pawl actuator drive rod 23 using the pawl rotational fastener 40. A pivot connector 38 is attached to the left side of the drive tube 32 using fastener hardware. The key 34 is also attached to the pivot connector 38 and rotates around the pivot connector 38 through a slit opening in the drive tube 32, when the pawl actuator 27 is activated.

Figure 9:
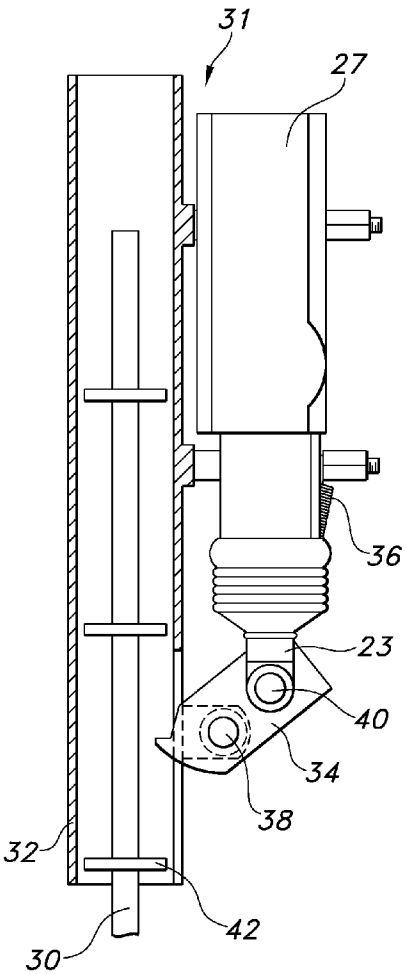
FIG. 9 is the same view as depicted in FIG. 7 illustrating the key in the locked position and the connector rod is extended outside the driver tube and the actuator is deactivated with its drive arm retracted.
Figure 8:
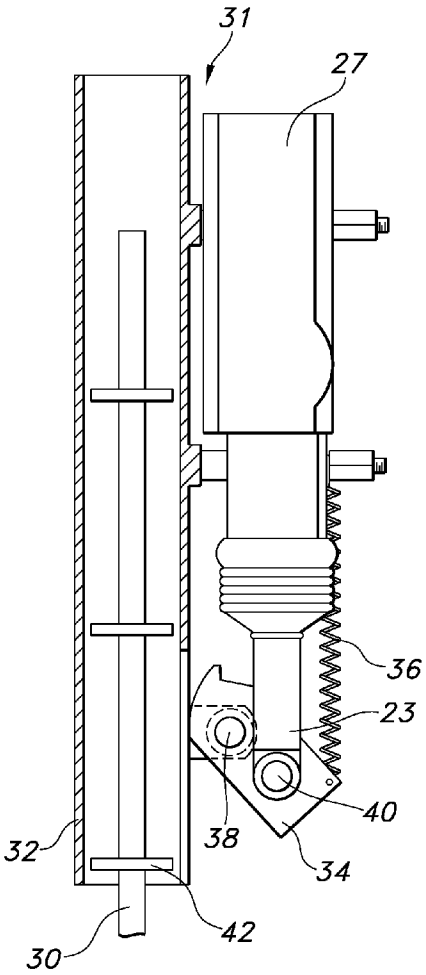
FIG. 8 is the same view as depicted in FIG. 7 illustrating the key in the unlocked position and the connector rod is extended outside the driver tube and the actuator is activated with its drive arm extended.
Figure 7:
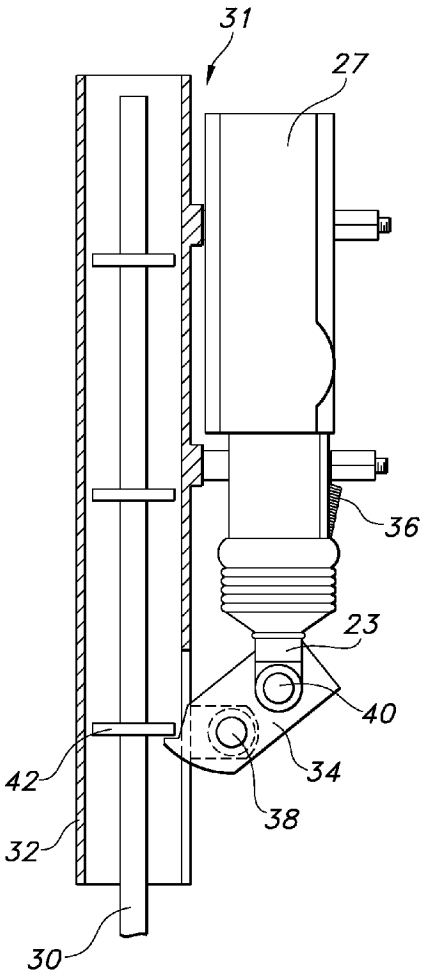
FIG. 7 is the top view of the powered pawl controller with a cut away of the drive tube, illustrating the key in the locked position and the connector rod is retracted inside the driver tube and the actuator is deactivated with its drive arm retracted.

Referring to FIGS. 7, 8, and 9, the drive tube 32 further includes the alignment spacers 42 that are attached to the connector rod 30 and both freely travel inside of the driver tube 32 and provides a latch for the key 34 to latch the connector rod 30 inside the driver tube 32. The connector rod 30 is attached to the pawl connector rod 48 to control the pawl 50, as shown in FIG. 10, using fastener hardware. There is a constant force pushing the pawl 50, the pawl connector rod 48 and the connector rod 30 forward, with respect to the frame, due to the pawl spring 52 of the pawl and ratchet latching mechanism 44 of the chair. The latching of the key 34 prevents the pawl 50 from latching to the ratchet hardware 46 of the chair, as shown in FIG. 10.

Referring to FIG. 7, the powered pawl controller 31 further illustrates the powered pawl controller 31 in the starting position with the pawl actuator 27 deactivated and the key 34 locking the alignment spacers 42 and the connector rod 30 inside the driver tube 32. In this position the connector rod 30 will not move forward, with respect to the frame, and out of the driver tube 32, which prevent the latching of the pawl and ratchet latching mechanism 44 of the chair. The occupant of the chair is able to extend the leg rest and manually or power rock the chair.

Referring to FIG. 8, the powered pawl controller 31 further includes the powered pawl controller 31 as the occupant of the chair has turned on the leg rest lock, which activate the pawl actuator 27 for a short period of time and extends the pawl actuator drive rod 23 to rotate the key 34 out of the driver tube 32. This action unlatches and releases the connector rod 30 from the key 34. The pawl spring 52, as shown in FIG. 10, pushes the connector rod 30 and pawl connector rod 48 forward, with respect to the frame, allowing the pawl 50 to latch to the ratchet hardware 46, and latch the position of the chair. The key 34 reverses direction and returns back into the driver tube 32 via the pulling force of the key spring 36 on the key 34 and the pawl actuator drive rod 23 as shown in FIG. 9. When the pawl 50 latches, the circuit board controller with power source 29 senses the latching and simultaneously shuts off the motor 05 and the automatic transmission assemble 20, which unlocks the rotational motor drive and the motor 05 rotates the motor arm 09 back to the original stopping position to prevent any damage to the motor 05 and or rotational motor drive.

Referring to FIG. 9, the powered pawl controller 31 further includes the powered pawl controller 31, after being turned on for a short period of time, the pawl actuator 27 is deactivated, with the key 34 with pawl actuator drive rod 23 is pulled back inside the drive tube 32 by the key spring 36 to its original lock position and the connector rod 30 remains extended forward, with respect to the frame, outside the driver tube 32 to release the pawl 50 to latch to the ratchet hardware 46 of the chair FIG. 10. To unlatch the pawl 50 from the ratchet hardware 46 and return the connector rod 30 back into the driver tube 32 to latch with the key 34 and unlatch the leg rest of the chair, the occupant of the chair need only to retract the leg rest with the rotational spring loaded lever on the side of the chair (not shown) and the connector rod 30 with the alignment spacers 42 will manually return back into the driver tube 32. The force of the returning alignment spacers 42 will manually rotate the key 34 backward out of the driver tube 32 allowing the alignment spacers 42 to bypass the key 34 and the alignment spacers 42 will latch to the key 34 to lock, when the key spring 36 returns the key 34 back into the driver tube 32 without the use of electrical power.

Referring to FIGS. 1, 2 and 3, the circuit board controller with power source 29 is illustrated being attached to the motor housing 03 with fastener hardware. The circuit board controller with power source 29 wiring includes the motor 05, the actuator 28 of the automatic transmission assemble 20, and the actuator 27 of the powered pawl controller 31. The circuit board controller with power source 29 takes commands from the operator with the use of a wireless key fob transmitting signals to a receiver in the circuit board controller with power source 29. The circuit board controller with power source 29 controls all the functions to the powered rocker system assemble 01.

When the powered rocker system assemble 01 stops, due to the of the pawl and ratchet latching mechanism 44 latching, to reset the system and restart the motor 05, the occupant of the chair need only to retract the leg rest manually, using the rotational spring loaded lever on the side of the chair (not shown), which returns the connector rod 30 back into the driver tube 32 to lock, and extend the leg rest again and restart the motor 05 which will simultaneously activate the automatic transmission assemble 20 and start the rocking motion again.

What is claimed is:

1. A powered rocker system assembly comprises:

a motorized rocking mechanism that is releasably secured to a frame of a rocking chair;

a means to provide unrestricted movement for manual rocking without any restrictions from the motorized rocking mechanism and without disconnecting the powered rocker system assembly from the frame;

a motor having a geared motor shaft, wherein said geared motor shaft is attached internally in the motor to transfer power to the rotational motor drive components;

a means for the motor to balance a rotational motion cycle; and a rotational motor drive comprising a motor arm; wherein said motor arm has a first end and a second end; wherein said rotational motor drive balances the chair occupied by a user to produce a combined balance for the powered rocker system assembly;

a circuit board controller with a power source;

a motor connector;

a chair connection slide;

multiple slider holes; and a chair connector pin;

wherein the motorized rocking mechanism comprises said circuit board controller with said power source and is connected to the motor to provide functional control and power to the motor;

wherein said motorized rocking mechanism is attached to the rotational motor drive at the first end of the motor arm with fastener hardware and the second end of the motor arm is attached to the motor connector using rotational hardware; wherein the motor connector encompasses the chair connection slide to allow the chair connection slide to freely move up and down, with respect to the frame, inside the motor connector to provide unrestricted movement for manual rocking; and wherein when the chair is occupied, the chair connection slide will move to a newly balanced position and the rotational motor drive will allow this new positioning without any restrictions from the motorized rocking mechanism and without disconnecting the powered rocker system assembly from the frame of the chair; wherein the chair connection slide comprises said multiple slider holes located along the length of the chair connection slide; and wherein the chair connection slide has the chair connector pin locate on the end using a rotational hardware.

2. The powered rocker system assembly of claim 1, wherein a motorized rocking mechanism that is releasably secure to the frame of the rocking chair further comprises:

a frame of the seat of the chair;

a chair connector pin;

a motor housing;

a frame angle rod; and a frame of the base of the chair with feet;

wherein the frame of the rocking chair comprises two frames, the frame of the seat of the chair that rocks on top of the frame of the base of the chair with feet;

wherein the motorized rocking mechanism with the rotational motor drive is attached to the frame of the seat of the chair with the said chair connector pin using a rotational hardware;

wherein the motor of the motorized rocking mechanism is attached to the motor housing using fastener hardware;

wherein the motor housing is attached to the top of the frame angle rod using fastener hardware; and wherein the frame angle rod is secured to the frame of the base of the chair with the feet of the chair sitting on top of the frame angle rod ends to releasable secure the powered rocker system assembly to the frame of the chair.

3. The powered rocker system assembly of claim 1, wherein a motorized rocking mechanism that provides unrestricted movement for manual rocking without any restrictions from the motorized rocking mechanism and without disconnecting the powered rocker system assembly from the frame of the chair further comprises:

a motor connector; and a chair connection slide;

wherein the motor connector encompasses the chair connection slide, which is separated by ball bearings, to allow the two components to freely slide unrestrictedly with the frame of the seat of the chair, while manually rocking and without disconnecting the powered rocker system assembly from the frame of the chair.

4. The powered rocker system assembly of claim 1, wherein a means for the motor to balance the rotational motion cycle and the rotational motor drive to balance the occupied chair to produce a combined balance for the powered rocker system assembly further comprises:

a motor; and a rotational motor drive;

wherein the motor when deactivated stops continually at the same position of ninety degrees off of top center of the rotational motion cycle and this locations is in the center and balance point of the rotational motion cycle which provides the same distance of travel forward as there is backward in the rotational motion cycle;

wherein the motor starts when activated and is starting every time at a balanced rotational motion cycle point; wherein said rotational motor drive allows the frame of the seat of the chair to move the connected chair connection slide inside the motor connector to a newly balanced position without any restriction from the motorized rocking mechanism;

wherein the chair and motor are both balance and ready for the automatic transmission assembly to lock the balanced position with the slider pin and the selected slider hole; and wherein the automatic transmission assembly is able to lock the chair connection slide with multiple slider holes at any balance point along the length of the chair connection slide of an occupied chair, when activated.

5. An automatic transmission assembly comprises:

a powered device with a means to automatically adjust to multiple balanced position of an occupied rocking chair;

a means to control a switching from manual to powered rocking to lock a position of a combined balance of the chair and motor, while eliminating unnecessary continual electrical use to reduce operating cost and prevent heat build up;

a means to control a switching from powered to manual rocking, while eliminating unnecessary continual electrical use;

an actuator housing; an actuator;

an actuator drive rod;
a rotational fastener;
a transmission drive rod;
a spring loaded pin; and
an automatic transmission;
wherein the actuator housing is attached to the actuator using fastener hardware with the actuator located inside of the actuator housing;
wherein the actuator comprises said actuator drive rod attached internally with said rotational fastener attached on the opposite exposed end;
wherein the rotational fastener is attached to one end of the transmission drive rod and the other end of the transmission drive rod attached to the spring loaded pin using fastener hardware;
wherein the spring loaded pin is located inside the automatic transmission and freely travels within the confines of the automatic transmission as needed;
wherein the automatic transmission is attached to said rotational motor drive at said motor connector using fastener hardware; and
wherein the automatic transmission encompasses the said rotational motor drive.

6. An automatic transmission assembly of claim 5, wherein a means to automatically adjust to multiple balanced position of an occupied rocking chair further comprises:
multiple slider holes;
wherein the balance position of the chair changes when the occupant sits on the chair and the frame of the seat of the chair connected to said chair connection slide moves within the confines of said motor connector up or down, with reference to the frame of the chair, allowing said automatic transmission traveling with said motor connector to adjust to a newly balanced position of the chair before any operations are performed on the chair;
wherein the automatic transmission, with the spring loaded pin, encompasses said motor connector and said chair connection slide with multiple slider holes and the spring loaded pin has the ability to freely travel toward said chair connection slide and away from said chair connection slide when the actuator is activated as needed;
wherein the chair connection slide has multiple slider holes in various, closely located positions along the longitudinal length of the chair connection slide to allow the automatic transmission to adjust to multiple balanced position along the length of the chair connection slide of an occupied rocking chair before accept the said spring loaded pin to connect said motor connector and said chair connection slide of the two sliding components of said rotational motor drive together;
wherein the motor starts the rotational motion in the middle of the motion cycle which balances the chair with the rotational motion cycle;
wherein if the chair and motor is balanced and a slider hole and spring loaded pin do not align for locking, the motor which is activated simultaneously by the circuit board controller with a power source will rotate the rotational motor drive to advance said motor connector with the attached automatic transmission and the chair connection slide together to align the closest slider hole with said spring loaded pin and the spring inside said spring loaded pin will quickly push the pin inside the selected slider hole to lock; and
wherein the balance point of the rotational motion cycle in not interrupted or very slightly altered due to the closeness of said multiple slider holes.

7. An automatic transmission assembly of claim 5, wherein a means to control the switching from manual to powered rocking to lock the position of the combined balance of the chair and motor, while eliminating unnecessary continual electrical use to reduce operating cost and prevent heat build up; and
a circuit board controller with a power source controls;
wherein the circuit board controller with a power source controls the functions of the said automatic transmission assembly when the motorized rocking mechanism is activated to locking said rotational motor drive by activating said actuator in one direction for a short period of time to extend the spring loaded pin into the selected slider hole of said chair connection slide, which connects said chair connection slide to said motor connector, thus locking said automatic transmission to make a rigid link between said motor and said frame of the seat of the chair for powered rocking and then deactivated said actuator after the short period of time to eliminating unnecessary continual electrical use to reduce operating cost and prevent heat build up while the components remain locked.

8. An automatic transmission assembly of claim 5, wherein a means to control the switching from powered to manual rocking, while eliminating unnecessary continual electrical use further comprises the circuit board controller with a power source controls the functions of the said automatic transmission assembly to unlocking said rotational motor drive by activating said actuator in the reverse direction for a short period of time to retract the spring loaded pin from the selected slider hole of said chair connection slide, which disconnects said chair connection slide from said motor connector, thus unlocking said automatic transmission to allow said chair connection slide to freely slide within the confines of said motor connector for manual rocking and then deactivated said actuator after the short period of time to eliminating unnecessary continual electrical use while the components remain unlocked.

9. The powered rocker system assembly of claim 1, further comprising:
a powered pawl controller comprising:
a powered device with a means of controlling the unlatching of the pawl and ratchet latching mechanism of the chair, without using electrical power to reduce operating cost and prevent heat build up and allows powered and manual rocking with the leg rest extended; and
a means of controlling the latching of the pawl and ratchet latching mechanism of the chair while simultaneously shutting off the motorized rocking mechanism and automatic transmission assembly, to eliminate any unnecessary continual electrical power use and prevent any damage to the motor and or rotational motor drive, while the pawl is latched.

10. The powered rocker system assembly of claim 9, wherein the powered pawl controller further comprises:
a drive tube;
a pawl actuator;
a pawl actuator drive rod;
a pawl rotational fasteners;
a pivot connector;
a key;
a key spring;
a connector rod; and
alignment spacers;
wherein the drive tube is attached to the top rear side of the motor housing, facing the leg rest of the chair, with reference to the frame, with fastener hardware;

wherein the connector rod is located and freely travels inside of said drive tube;

wherein said connector rod has alignment spacers attached at different location along the length of said connector rod and freely travel throughout said drive tube as a guide for said connector rod;

wherein said alignment spacers keep said connector rod in a fixed center position inside the circular wall of said drive tube;

wherein a pivot connector is attached to said drive tube at the slit opening on the side wall of said drive tube using fastener hardware;

wherein the pawl actuator is attached to said drive tube in line with said pivot connector at the slit opening on the side wall of said drive tube using fastener hardware;

wherein the pawl actuator provides the power for the operations of the powered pawl controller;

wherein a pawl actuator drive rod is attached internally in said pawl actuators with the pawl rotational fastener located on the exposed end of the pawl actuator drive rod;

wherein said pawl actuator drive rod extends when said pawl actuator is activated for a short period of time and then deactivates to eliminate the continual electrical power use;

wherein the key is located partially in the slit opening of said drive tube and configured to latch to said alignment spacers on one end of the key and is attached to said pawl rotational fastener on the opposite end of the key;

wherein the pawl actuator drive rod and pawl rotational fastener is a means to push the key when said pawl actuator is activating to extend said pawl actuator drive rod; wherein said key is attached to said pivot connector near the middle of said key with rotational hardware;

wherein said pivot connector is the pivot point for said key to rotate around, when pushed or pulled by said pawl actuator drive rod;

wherein the key spring is attached in between said key and said pawl actuator fastener hardware with a pulling force on said key and said actuator drive rod toward said pawl actuator fastener hardware;

wherein said key is attached to the key spring located at the same end where said pawl rotational fastener is attached to said key;

wherein said pawl actuator fastener hardware is attached to said key spring at the opposite end of said key spring; and wherein said pulling force of said key spring is a means to pull said key back into said drive tube when said pawl actuator drive rod and said key is extended and said pawl actuator is deactivated.

11. The powered rocker system assemble assembly of claim 9, wherein the pawl and ratchet latching mechanism of the chair further comprises:

a rotational spring loaded lever;

a pawl connector rod; a pawl;

a pawl spring;

a frame of the base of the chair;

and a ratchet hardware;

wherein the rocking chair manufacturer provided a pawl and ratchet latching mechanism to the chair to latch the position of the chair when the leg rest is extended and the chair is out of balance;

wherein the rocking chair has a rotational spring loaded lever attached to the side of the rocking chair which is connected to the pawl connector rod of said pawl and ratchet latching mechanism of the chair;

wherein the pawl is attached to the end of said pawl connector rod; wherein said pawl has a pawl spring attached to the base of said pawl and the base of the frame of the chair with a forward pushing force, with reference to the frame, on said pawl;

wherein the ratchet hardware is mounted on the frame of the seat of the chair below the leg rest;

wherein said rotational spring loaded lever is manually rotated to extend the leg rest which release said pawl to latch to said ratchet hardware by said pawl spring which locks the position of the chair to keeps the chair from any movement while unbalanced; and wherein said rotational spring loaded lever is manually rotated in the opposite direction to retract the leg rest which retracts said pawl to unlatch from said ratchet hardware which unlocks the position of the chair and allows the chair to rock.

12. The powered rocker system assembly of claim 9, wherein the a means of controlling the unlatching of the pawl and ratchet latching mechanism of the chair, without using electrical power to reduce operating cost and prevent heat build up and allows powered and manual rocking with the leg rest extended further comprises:

a connector rod;

a pawl connector rod;

a key;

a pawl; and a ratchet hardware;

wherein the rocking chair contains said pawl and ratchet latching mechanism incorporated from the manufacturer into the chair;

wherein said connector rod is attached to said pawl connector rod with fastener hardware;

wherein the pawl connector rod with the pawl is unlatched from the ratchet hardware of said pawl and ratchet latching mechanism of the chair before the rotational spring loaded lever of the chair is manually rotated to extend the leg rest;

wherein when the rotational spring loaded lever of the chair is manually rotated to extend the leg rest which normally allows the pawl spring to push the pawl forward to latch the pawl to the ratchet hardware, the key of said powered pawl controller will restrain the connector rod from moving out of the drive tube and prevent the pawl from moving forward to latch with the ratchet hardware which retains the unlatched position of the pawl to allows manual or powered rocking while the leg rest is extended and without use of electrical power; and wherein the elimination of electrical power use reduces operation cost and prevents heat build up.

13. The powered rocker system assembly of claim 9, wherein a means of controlling the latching of the pawl and ratchet latching mechanism of the chair while simultaneously shutting off the motorized rocking mechanism and automatic transmission assembly, to eliminate any unnecessary continual electrical power use and prevent any damage to the motor and or rotational motor drive, while the pawl is latched further comprises:

a pawl and ratchet latching mechanism of the chair;

a powered pawl controller; and a circuit board controller with power source;

wherein said connector rod is attached to said pawl connector rod with fastener hardware;

wherein said circuit board controller with power source activates the pawl actuator of said powered pawl controller to extend the pawl actuator drive rod and rotate the key to release the connector rod from the drive tube, allowing the pawl spring of said pawl and ratchet latching mechanism of the chair to push the pawl forward to latch to the ratchet hardware of the chair and retain the position of the chair, while the chair has the leg rest extended; and wherein said circuit board controller with power source controls the functions and power to said powered pawl controller and when sensing the latching of said pawl and ratchet latching mechanism will simultaneously shuts off the motor, unlocks the automatic transmission and deactivates the actuator and the pawl actuator, to eliminate any unnecessary continual electrical power use and prevent any damage to the motor and or rotational motor drive, while said pawl is latched.

* * * * *